United States Patent [19]

Klenk et al.

[11] Patent Number: 4,508,214

[45] Date of Patent: Apr. 2, 1985

[54] TIGHTENING MEANS FOR AT LEAST ONE PRESSER BELT ASSOCIATED WITH A TAIL PULLEY OF A CONTINUOUS SHEET FEEDER

[75] Inventors: Emil Klenk; Karl-Fritz Heina, both of Murrhardt, Fed. Rep. of Germany

[73] Assignee: Maschinenbau Oppenweiler Binder GmbH & Co., Fed. Rep. of Germany

[21] Appl. No.: 490,440

[22] Filed: May 2, 1983

[30] Foreign Application Priority Data

May 17, 1982 [DE] Fed. Rep. of Germany ..... 3218566

[51] Int. Cl.[3] ..... B65G 23/44

[52] U.S. Cl. ..... 198/833; 198/814; 474/117

[58] Field of Search ..... 198/813, 814, 816, 815, 198/499, 833; 474/101, 110, 111, 113, 115, 117

[56] References Cited

U.S. PATENT DOCUMENTS

| | | | |
|---|---|---|---|
| 832,361 | 10/1906 | Blevins | 198/816 |
| 1,875,442 | 9/1932 | Greg | 198/499 |
| 2,833,394 | 5/1958 | Cordis | 198/814 |
| 2,920,751 | 1/1960 | Krupp et al. | 198/814 |
| 3,142,193 | 7/1964 | Polko et al. | 474/110 |
| 3,214,001 | 10/1965 | Callaghan | 198/814 |
| 3,292,772 | 12/1966 | Rice | 198/816 |
| 3,370,693 | 2/1968 | Marsden | 198/815 X |
| 4,089,407 | 5/1978 | Bullivant | 198/815 |

FOREIGN PATENT DOCUMENTS

| | | | |
|---|---|---|---|
| 336737 | 10/1930 | United Kingdom | 198/814 |
| 1090851 | 11/1967 | United Kingdom | 198/813 |
| 259533 | 4/1970 | U.S.S.R. | 198/816 |

*Primary Examiner*—Joseph E. Valenza
*Assistant Examiner*—Jonathan D. Holmes
*Attorney, Agent, or Firm*—John F. A. Earley; John F. A. Earley, III

[57] ABSTRACT

For simple and rapid tightening of one or more presser belts of a continuous sheet feeder two support-levers are connected to a swivelling shaft next to the feeder frame, at the free ends of which the tension roller is pivoted. Furthermore, a tension lever is connected to the swivelling shaft. A holding member is slidably mounted on the swivelling shaft and can be fixed in any set position. One end of a spring engages the holding member and the other end is pivoted on the feeder.

4 Claims, 4 Drawing Figures

TIGHTENING MEANS FOR AT LEAST ONE PRESSER BELT ASSOCIATED WITH A TAIL PULLEY OF A CONTINUOUS SHEET FEEDER

DESCRIPTION OF THE PRIOR ART

This invention concerns a tightening means for at least one presser belt associated with a tail pulley of a continuous sheet feeder comprising at least one support-lever connected to a swivelling shaft pivoted in the feeder frame and having a tension roller for the presser belt pivoted at its free end, and further comprising a spring, one end of which is connected to the feeder frame and which acts on the support-lever at various distances from its swivelling shaft to thus produce a varied tightening force.

A continuous sheet feeder normally comprises a multiple of presser belts arranged a distance apart. Associated with each of these presser belts is an extra tightening means which comprises a lever that is pivoted at the end towards the feeder frame and which has the tension roller pivoted at its other end. The lever has a multiple of bores arranged along its length. One end of a biasing spring engages one of theses bores and the other end is connected to the feeder frame. When any one of the presser belts has to be tightened further, the spring is inserted into the bore which causes the spring to be further expanded.

The overall construction of the continuous sheet feeder is relatively complicated because an extra tightening means has to be provided for each tension roller. In order to shift the spring, the continuous sheet feeder has to be stopped which means that much setting time is necessary. Moreover, the shifting of the spring requires much strength or auxiliary means. It is very difficult to obtain an even pressing force for all presser belts. Furthermore, the speed of the presser belts varies dependent on the height of the stack of sheets to be fed off. This results in a speed difference occurring between the presser belts and the belt or belts running around the tail pulley, which may cause the sheet stack being fed off the become "plucked asunder".

OBJECT OF THE INVENTION

It is therefore the object of the invention to embody the tightening device of the kind described above using simple means so as to ensure proper feeding of the paper stack without it being torn asunder.

SUMMARY OF THE INVENTION

Using a tightening means of the kind described above as a starting point, this object is solved by a tension lever disposed outside the feeder frame on the swivelling shaft and by a holding member slidably arranged on the tension lever and engaged by the other end of the spring and fixable in a given setting position.

The tightening means according to the invention has the advantage that the pressing force is the same for all presser belts while at the same time the operation of the continuous sheet feeder can be set infinitely variably. When carrying out this adjustment the behaviour of the stack of sheets can be observed when being fed off and influences resulting from various degrees of friction between different kinds of paper can be compensated very simply and it is ensured that the individual sheets are fed off in the cycle of a suction roll. Such observation of the stack of sheets is very important in the case of very limp kinds of paper.

A particularly favourable setting of the force is provided by forming an angle of substantially 90° between the axis of the spring in its middle position and the tension lever.

It is also advantageous if the spring is a gas pressure spring since the latter has an almost constant force over the spring excursion.

A particularly advantageous infinitely variable adjustment of the holding member by hand is provided if the holding member comprises a bore having an internal screw thread engaged by a spindle which extends substantially parallel to the tension lever and is rotatably mounted while being axially fixed thereon. When the holding member is once set, the set position is fixed by the friction in the thread.

BRIEF DESCRIPTION OF THE DRAWINGS

The invention will now be described in more detail in the following by way of example and with reference to the drawing, in which.

DETAILED DESCRIPTION OF A PREFERRED EMBODIMENT OF THE INVENTION

Figure 1:
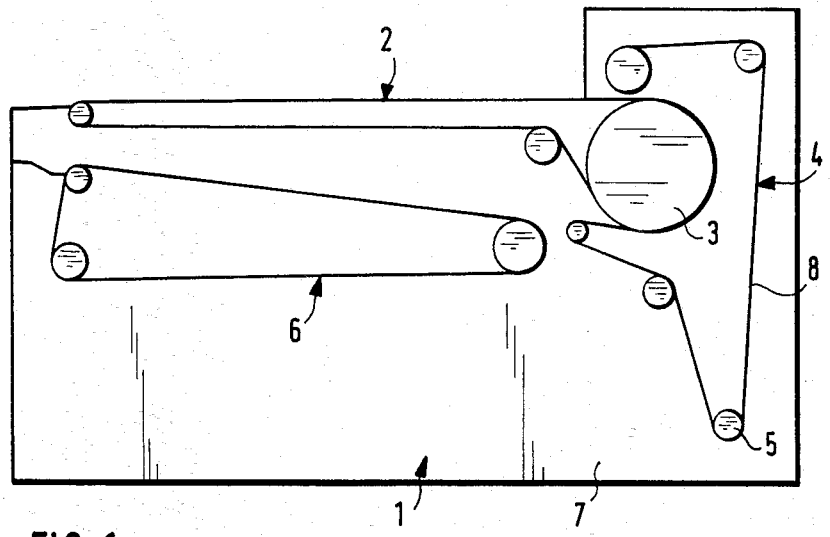
FIG. 1 is a schematic lateral view of a continuous sheet feeder.

The continuous sheet feeder 1 shown in FIG. 1 has a feeder frame 7 in which the individual structural elements are held or disposed. The continuous sheet feeder 1 comprises a first conveying belt 2 associated with a feedboard, having a tail pulley 3 and a second conveying belt 4, the presser belts 8 of which are pressed against the tail pulley 3 for deflecting the sheets from a stack and which are held tight by a tension roller 5. The second conveying belt 4 guides the sheets deflected about the tail pulley 3 to a conveying belt 6 associated with a removing table.

Figure 2:
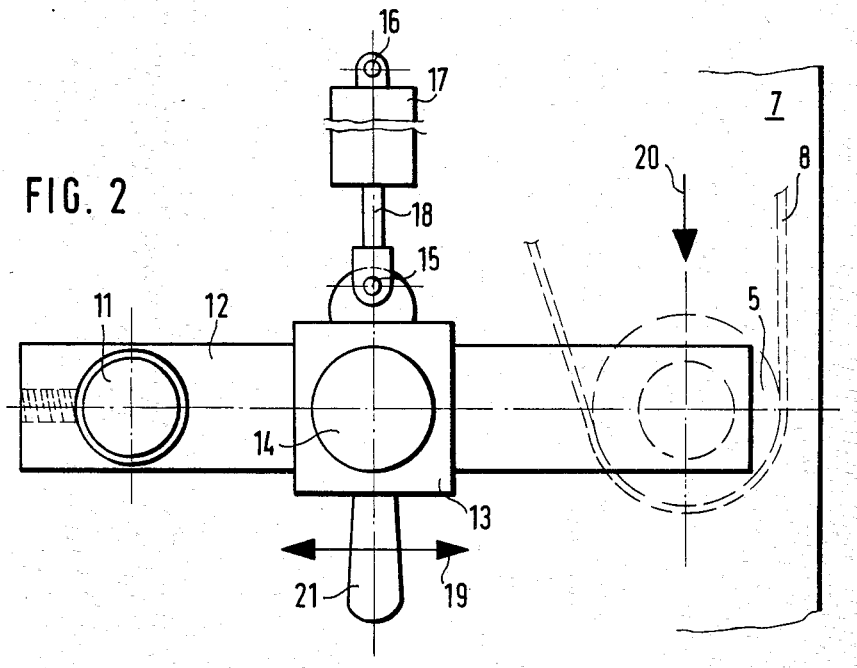
FIG. 2 is a lateral view of the tightening means associated with the tension roller of the continuous sheet feeder according to FIG. 1.
Figure 3:
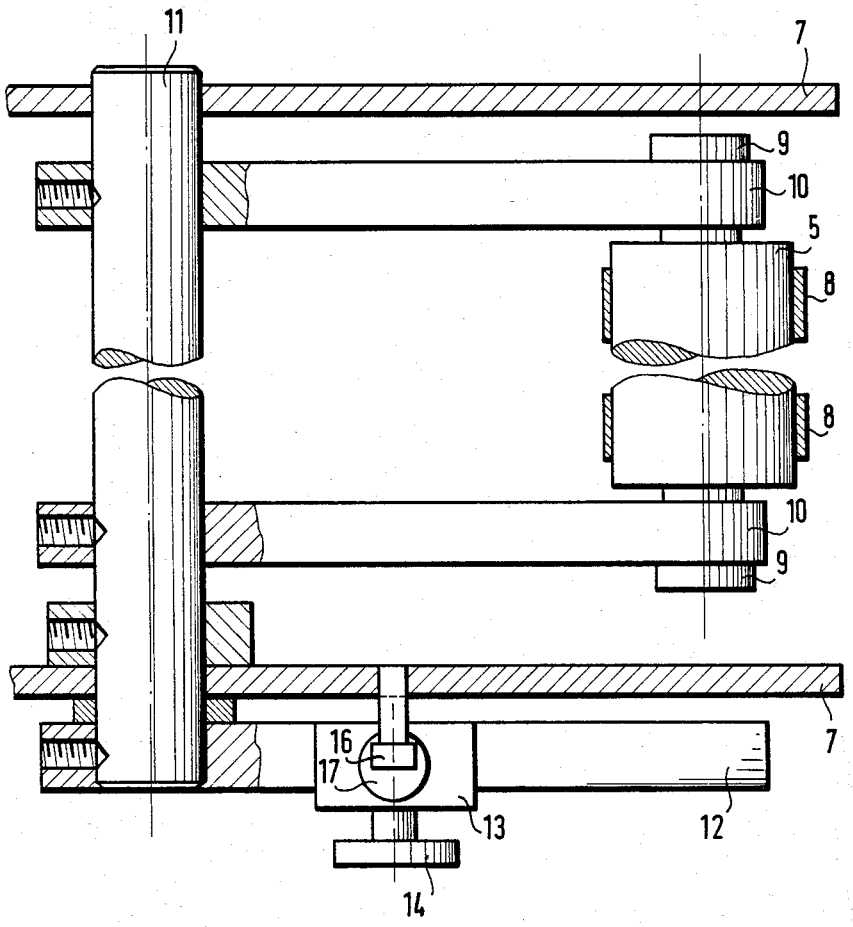
FIG. 3 is a partially sectioned plan view of the tightening means according to FIG. 2.

As can be seen from FIGS. 2 and 3, the tightening means comprises a swivelling shaft 11 which is pivotally mounted in the feeder frame 7. Support-levers 10 are fixed to the swivelling shaft 11 next to the respective walls of the feeder frame 7. Journals 9 of the tension roller 5 are mounted at the free ends of the support-levers 10. A number of presser belts 8 (not shown in further detail) run on the tension rollers 5. A tension lever 12 is arranged on the outer side of the wall of the feeder frame 7 on the swivelling shaft 11 in parallel relationship to the support-levers 10. A holding member 13 is slidably mounted on the tension lever 12. The holding member 13 can be shifted in the direction of the double arrow 19 by means of a handle 21 arranged on the bottom side and can be fixed in the set position on the tension lever 12 by means of a handwheel 14 which operates a clamping means (not shown). On the upper side opposite the handle 21, the holding member 13 has a swivelling joint 15 to which one end of a spring 17 is connected, the other end of which is pivotally mounted in a joint 16 on the outside to the wall of the feeder frame 7. The spring 17 shown in FIG. 2 is a gas pressure spring, the piston rod 18 of which engages the joint 15.

In the position shown in FIG. 2 in which the longitudinal axis of the tension lever 12 having a rectangular cross-section runs perpendicular to the axis of the spring 17, the pressure of the spring 17 provides for a swivelling moment at the swivelling shaft 11. The lever arm of this swivelling moment corresponds to the axial distance between the axis of the swivelling shaft 11 and the longitudinal axis of the spring 17. This moment is transmitted to the support-levers 10 by the swivelling shaft 11 and acts with a correspondingly longer lever arm on the journals 9 of the tension roller 5 pivoted at the free end of the support-lever 10. By shifting the holding member 13 in one of the two direction indicated by the double arrow 19 in FIG. 2, both the lever arm and the force component perpendicular thereto, which is exerted by the spring 17, are changed. Thus it is possible in a simple manner to quickly adjust the tightening force for the presser belts 8 that is desired at the tension roller 5.

Figure 4:
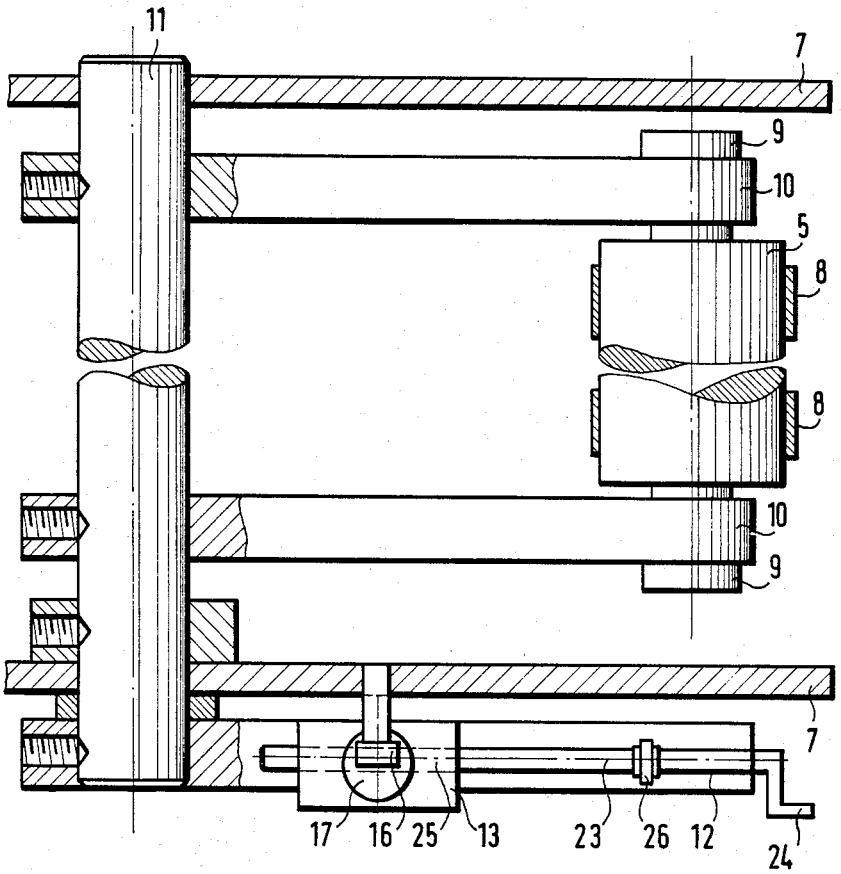
FIG. 4 shows a modification of the tightening means according to FIG. 3.

In the embodiment example shown in FIG. 4 a threaded bore 25 is provided in the holding member 13 which runs parallel to the longitudinal extension of the tension lever 12. This threaded bore 25 is engaged by the outer thread of a spindle 23 which is rotatable in a bearing block 26 on the tension lever 12 but which cannot be moved in the axial direction. When the spindle 23 is turned with the handle 24 the holding member 13 is shifted by the thread engagement in one or other of the direction indicated by the double arrow 19 in FIG. 2. It is not necessary to fix a set position between the holding member 13 and the tension lever 12 because the position is maintained due to the friction of the thread engagement.

What is claimed is:

1. A tightening means for at least one presser belt associated with a tail pulley of a continuous sheet feeder comprising:

a tension roller for the presser belt, at least one support-lever pivotally connected at one end to the tension roller, the tension roller being unattached to the feeder frame and being supported only by the support-lever, a swivelling shaft rigidly connected to the other end of the support-lever, the swivelling shaft further being pivotally mounted adjacent each end to opposite walls of a feeder frame, a spring connected at one end to the feeder frame, the spring being connected at the other end to a tension lever by a holding member slidably arranged on the tension lever, the tension lever being rigidly connected at one end to the swivelling shaft outside the feeder frame, whereby the holding member can be placed at variable distances from the swivelling shaft to vary the tightening force on the presser belt as desired.

2. A tightening means according to claim 1, characterized in that an angle of substantially 90° is formed between the axis of the spring (17) in its middle position and the tension lever (12).

3. A tightening means according to claim 1, characterized in that the spring (17) is a gas pressure spring.

4. A tightening means according to claims 1, 2 or 3, characterized in that the holding member (13) comprises a bore (25) having an internal screw thread engaged by a spindle (23) which extends substantially parallel to the tension lever (12) and is rotatably mounted while being axially fixed thereon.

* * * * *